United States Patent [19]

Galer

[11] Patent Number: 4,619,373

[45] Date of Patent: Oct. 28, 1986

[54] PLASTIC PAINT CONTAINER

[76] Inventor: Herbert W. Galer, 24 Woodland Trail, Newna, Ga. 30263

[21] Appl. No.: 784,549

[22] Filed: Oct. 4, 1985

[51] Int. Cl.[4] ..... B65D 43/06

[52] U.S. Cl. ..... 220/354; 220/307; 220/306; 150/55

[58] Field of Search ..... 220/354, 306, 307; 150/55

[56] References Cited

U.S. PATENT DOCUMENTS 4,512,494 4/1985 Von Holdt ..... 220/307

4,530,442 7/1985 Vogel, Jr. et al. ..... 220/354

*Primary Examiner*—George T. Hall

*Attorney, Agent, or Firm*—Sumner C. Rosenberg; William H. Needle

[57] ABSTRACT

An improved plastic container assembly is disclosed, for use such as a paint can, which comprises a bottom container portion, a ring portion which fits within the upper rim of the bottom container portion, and a lid which seals within said ring portion to close the container. The ring portion of the invention interlocks within the inner circumference of the bottom container portion to form a tight fit and a good seal to retain the contents of the container.

13 Claims, 6 Drawing Figures

PLASTIC PAINT CONTAINER

BACKGROUND OF THE INVENTION

This invention relates to containers, and more specifically, plastic containers. The container described herein may be applied to any use, but is particularly useful as a paint container.

Steel paint pails with a friction fit lid have been a standard in the paint industry for many years. However, with the development of latex paints, steel containers are no longer desirable because of corrosion problems with the containers. Consequently, the use of plastic in paint containers has been developed to replace steel containers. These include containers that utilize a plastic lower portion with a crimp-on steel ring. However, such designs still have a corrosion problem.

All plastic containers are well known in the art. For example, the following patents disclose all plastic containers and lid arrangements: U.S. Pat. No. 3,977,563 to Holt, U.S. Pat. Nos. 4,293,080 and 4,349,119 to letica, and U.S. Pat. No. 4,512,494 to Von Holdt.

The first three of the above referrenced patents disclose two piece containers wherein the lid interlocks around and outside the upper lid of the bottom container portion. This design has proven to be disadvantageous because the lids and containers cannot be used with existing canning machinery designed for steel containers. The lids are too large in diameter and, therefore, will not fit the lid machinery that feeds the container line. The container is not acceptable because of the increased height required to offset the volume decrease caused by the necked-in reinforced section of the container.

The Van Holdt patent discloses a container which more nearly approximates the design of standard steel paint cans. However, due to the inner extension required at the upper circumference of the container, this design requires a complex and expensive mold apparatus, such as internally collapsible mold core, for the lower portion of the container.

SUMMARY OF THE INVENTION

The present invention is an improved plastic container assembly which comprises a bottom container portion, a ring portion which fits within the upper rim of the bottom container portion, and a lid which seals within said ring portion to close the container. The lid may be removed by prying it off and the container may be reclosed by replacing the lid. All of the parts of the container are plastic and are intended to be formed by a molding process. Typical plastic materials that can be utilized includes polyethylene and polypropylene.

More specifically, the ring portion of the present invention interlocks within the inner circumference of the rim of the bottom container portion, with or without overlapping the rim to surround the outer circumference of the rim. This is accomplished by means of one or more annular ribs on the inner circumference of the container slightly below the top edge of the rim. The ring has complementary annular recesses on its outer circumference which mate with the aforementioned ribs to hold the ring in place within the rim of the container. In order to accomplish the objectives of this invention the ribs extend a relatively small distance inside the container and consequently the ring must tightly fit with the container to form a good seal and interlock. This result is accomplished by means of utilizing a shrink-fit process to assemble the two pieces.

Furthermore, one goal of the present invention is to provide a container which can be molded without use of a collapsible core mold or similarly complicated mold design. The present invention is designed to be molded by simpler and more economical means, and one possible mold design is described in a co-pending application application, Ser. No. 785,774, filed Oct. 9, 1985.

The ring portion also has within it an upward facing circular channel intended to receive a complementary downward extending flange of a lid, in order to accomplish the closing of the container. The end of the flange of the lid may have an inwardly extending annular ridge and the channel of the ring may have a complementary recess to allow a snap fit for more positive closure, and sealing of the container. Furthermore, the flange of the lid may be narrower than the channel of the ring and have circumferentially spaced verticle ribs around the flange to allow paint within the channel of the ring to flow into the open spaces between said verticle ribs when the lid is placed on the container, thereby allowing the desired tight closure. Of course, the verticle ribs and the ridge of the lid may be reversed from outside to inside, and vice versa, to accomplish the same objective.

Preferably, when the invention is intended to be used as a paint container, it will be of the same outer dimensions and shape of standard size steel paint cans. As a result, the present invention may be used on paint filling lines interchangeably with steel containers.

Therefore, it is an object of the present invention to provide an all plastic container assembly having simple but utilitarian design.

It is a further object of the present invention to provide an all plastic container assembly which is interchangeable with steel containers.

It is another object of the present invention to provide an all plastic container assembly which may be molded without the use of collapsible core molds.

It is yet a further object to provide an economically produced standard size non-corroding container.

These and other objects and advantages will appear from the following description with reference to the drawings.

DESCRIPTION OF THE PREFERRED EMBODIMENT

The preferred embodiment is now described with reference to the drawings, in which like numbers indicate like parts throughout the views.

Figure 1:
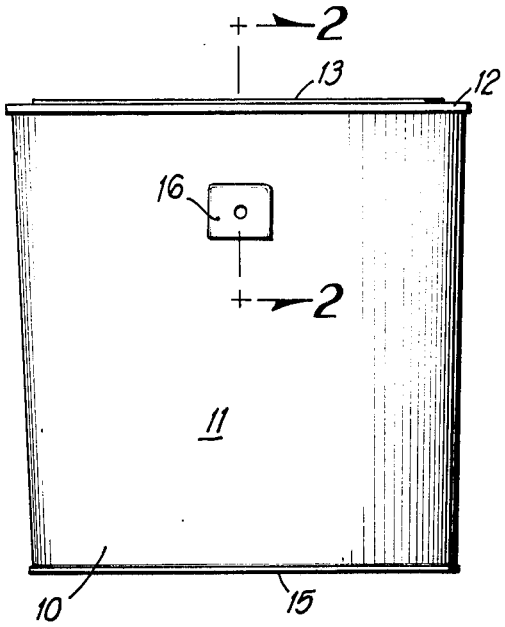
FIG. 1 is a front view of a container assembly of this invention.

FIG. 1 shows the container assembly 10 of the present invention as, for example, a paint can. The container assembly comprises three main parts: the generally cylindrical container 11, a ring 12 and a lid 13. The cylindrical container 11 has a closed bottom 15 and open top. The container may also have a bail ear 16 for connecting a carrying bail to the container. The ring 12 fits within the top edge of the container 11, and is intended to remain fixed. The lid 13 fits within a channel 17 within the ring 12 when the container assembly is closed. Each of the three main parts are made of plastic.

Figure 2:
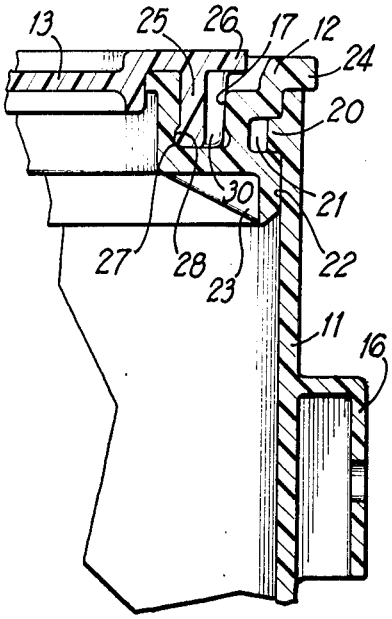
FIG. 2 is an enlarged partial cross-section taken along lines 2—2 in FIG. 1 of the area where the parts of a first embodiment of the container assembly of FIG. 1 join together.

FIG. 2 shows the joining of the three main parts of the container assembly in greater detail. The ring 12 is joined to the container 11 by means of an annular rib 20 which is on the inside circumference of the container 11 and a complementary annular recess 21 on the outer circumference of the ring 12, within the otherwise flat face 22 of the ring 12 which fits flush against the inside of the container, whereby the rib 20 fits within the recess 21. The corners of the rib 20 and recess 21 are preferably squared as right angles. The ring may also have reinforcement ribs 23 to stiffen the ring structure.

Clearly, in order to provide a leakproof container, the dimensions of the inner diameter of the container and the outer diameter of the ring must be about the same to a close tolerance. The parts must also be designed to allow them to be fit together while allowing for the tight fit. For example, in a standard size paint can this diameter may be 6.285 inches at normal temperatures. The rib 20 has a width of approximately 0.060 inches. In order to fit the ring 12 within the container 11, a shrink-fit process may be used, wherein the cold ring is inserted within the container 11 soon after the container is removed from its mold and is, therefore, still very hot. The inner diameter of the container will be expanded in this hot container to about 6.325 inches and, therefore, the inner diameter at the rib portion 20 of the container will be about 6.225 inches. This expansion removes about 0.060 inches of the interference between the container and the ring. Because of the stretchability of the plastic material, the ring can be forced into the container until it snaps into assembled position. When the container cools, a tight fit is formed between the parts 11 and 12. The dimensions may be varied by providing the ring with an outer diameter slightly larger than the inner diameter of the container to result in a more snug fit between the parts. The rib 20 and recess 21 thereby form the interlock between the ring and container which holds the ring in place. The ring may also have an annular outward extension 24 at its top edge, which lies near the top edge of the container. This extension serves both to hold the ring in position during the shrink-fit process described above, as well as to provide a further resistance to downward forces on the top of the complete container assembly.

The ring 12 has a circular channel 17 which opens upward to receive a flange 25 on the lid 13 when the lid is in a closed position in said container assembly. The lid also has a lip extension 26 which is outside the flange 25 and is designed to provide a space between the ring 12 and the lid 13 and a means for prying open the lid.

The lid flange 25 also has an inwardly extending ridge 27 around its periphery and the channel 17 has a complementary recess 28 to provide a secure closure between the lid and the ring. For a standard size paint container, an extension of 0.030 inches for the flange ridge 27 will assure a functional engagement between the parts.

Figure 3:
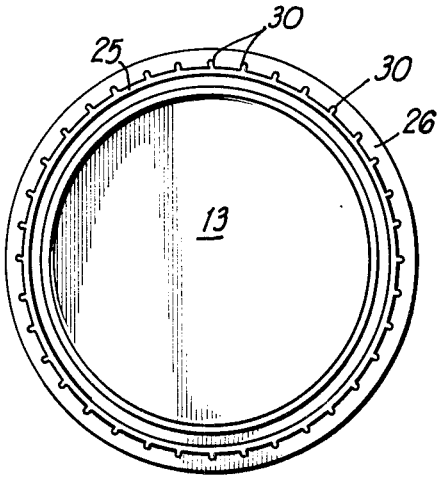
FIG. 3 is a view of the underside of the lid of the container assembly.

In FIG. 2 it is seen that the width of the flange 25 is approximately half of the width of the channel 17. Of course, the width of the flange could be made the same as the width of the channel. However, in use, paint containers often are reused, and paint usually will spill into the channel. Thus, the narrower flange 25 in FIG. 2 will allow space for paint to move into when the lid is reclosed. In order to ensure a secure fit between the flange 25 and the channel 17, verticle spacer ribs 30 are provided which are spaced circumferentially around the outside of the lid flange 25, as is shown in FIG. 3, wherein the combined width of the verticle rib and flange is about the same as the width of the channel. Consequently, when the lid is replaced on the container, paint in the channel can occupy space between the verticle ribs.

Figure 4:
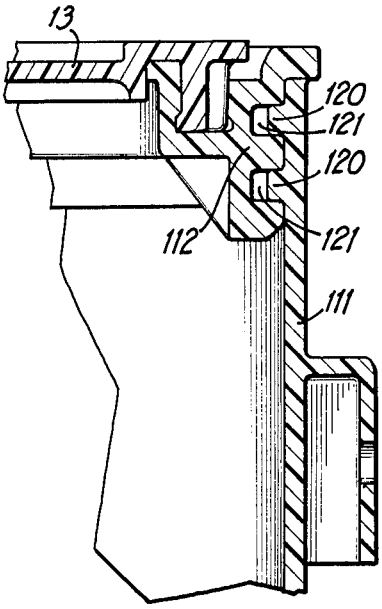
FIG. 4 is an enlarged partial cross-section of the area where the parts of a second embodiment of the container assembly join together.

FIG. 4 shows a second embodiment of the present invention which provides more than one interlocking rib 120 and complementary recess 121 for holding the ring 112 within the rim of the container 111, or the rib and recess may be one continuous spiral. Embodiment utilizing a plurality of ribs may be desirable in larger containers subject to greater internal and external stresses.

Figure 5:
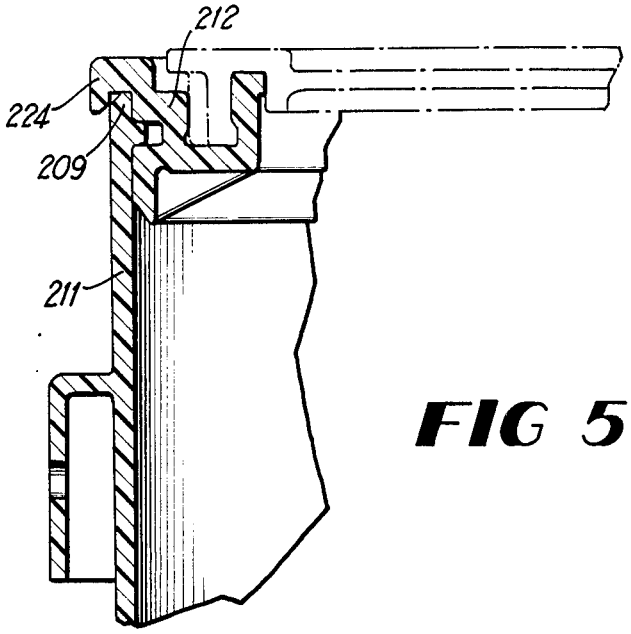
FIG. 5 is an enlarged partial cross-section of the area where the ring and container of a third embodiment where the container assembly join together.

FIG. 5 shows a third embodiment of the present invention, wherein the ring 212 has, instead of the annular outward extension 24 of FIG. 1, an annular outer flange 224 which surrounds the outer periphery of the rim 209 of the container 211. By overlapping the rim, the annular outer flange 224 will resist internal pressure from causing the container 211 to be pushed away from the ring 212, which will improve the usefulness of the present invention where the contents may generate internal pressure.

Figure 6:
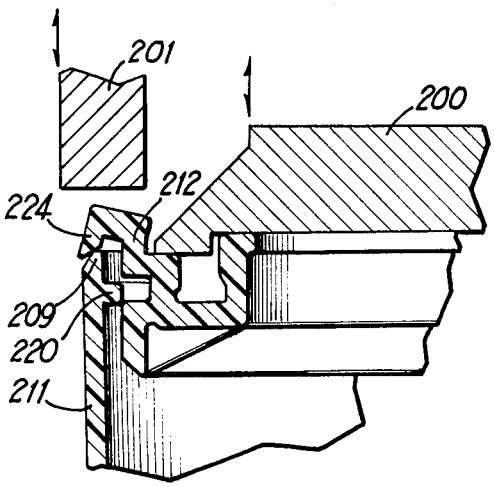
FIG. 6 is a partial cross-section view showing the installation of the ring of FIG. 5 into the container.

Since the outer flange 224 will prevent the ring from being easily placed within a hot container as described for the first embodiment, the shrink-fit process must be modified as shown in FIG. 6, for the embodiment of FIG. 5. FIG. 6 shows a two stage closing tool whose first stage 200 pushes the ring past the locking ribs 220 while the container 211 is hot and the ring 212 is cold. This action forces the outer flange 224 portion of the ring ot be distorted upward. The second stage 201 of the closing tool then pushes the outer flange 224 downward into position around the rim 209. When the container 211 cools a tight fit is obtained.

While the invention has been described in detail with particular reference to the preferred embodiment thereof, it will be understood that variations and modifications can be effected within the spirit and scope of the invention as previously described and as defined by the claims.

What is claimed is:

1. A resealable plastic container assembly comprising:

a generally cylindrical plastic container having a bottom end, an upward extending sidewall, an open top and at least one annular rib on its inner circumference near its top;

a plastic ring, having at least one annular recess on its outer circumference complementary to the ribs of said container fitted within the inner circumference of the rim of the open top end of said container, said ribs and said recesses mated in interlocking relationship between said container rim and said ring to provide a permanent and continuous leakproof seal between said container and said ring, said ring further comprising a channel along the inner periphery thereof opening upward with respect to the bottom of said container; and a lid for removable attachment with said ring comprising a substantially flat disk having a downwardly extending flange at the periphery of said disk adapted to fit within the channel of said ring and to provide a tight leakproof seal between said top and said ring, and further comprising a lip extension beyond said flange around the periphery of said lid at the top of said flange, for prying open said lid from said ring and container.

2. The container assembly of claim 1, wherein said rib at the top of said container extends inwardly a distance sufficient to hold said ring tightly in place under normal conditions, but such extension of the rib is sufficiently small to allow said ring, when cool, to fit within the inner circumference of the rib when said container is very hot, such that the two parts may be shrink-fit together shortly after the container is removed from its mold.

3. The container assembly of claim 1, wherein said rib and said recess are spirals such that the said ring may be screwed into said container.

4. The container assembly of claim 2, wherein said ring further comprises an annular extension at its top edge which extends outwardly to at least the outer circumference of said container, whereby said extension provides a fitting guide for installation of said ring and an additional resistance to downward forces on said ring during normal use of the container assembly.

5. The container assembly of claim 2, wherein said ring further comprises an annular outer flange at its top edge which extends outwardly and surrounds the rim of said container, whereby said outer flange will hold the inner circumference of said container against the outer circumference of the ring when the closed container assembly is under pressure.

6. The container assembly of claim 1, wherein the downward extending flange of said lid has an inwardly extending annular ridge at its end, and the inside wall of the channel of said ring has a recess complementary to said ridge, whereby a secure lock may be formed between said lid and said ring when said lid is used to close the container.

7. The container assembly of claim 1, wherein the width of the downward extending flange of said lid is narrower than the width of the channel of said ring and wherein the downward extending flange further comprises vertical ribs spaced circumferentially around the outer periphery of said flange such that said vertical ribs extend the length of the downward extending flange and the combined width of the flange and said vertical ribs are about equal to the width of the channel of said ring.

8. The container assembly of claim 6, wherein the width of the downward extending flange of said lid is narrower than the width of the channel of said ring and wherein the downward extending flange further comprises vertical ribs spaced circumferentially around the outer periphery of said flange such that said vertical ribs extend the length of the downward extending flange and the combined width of the flange and said vertical ribs are about equal to the width of the channel of said ring.

9. The container assembly of claim 1, wherein the downward extending flange of said lid has an outwardly extending annular ridge at its end, and the outside wall of the channel of said ring has a recess complementary to said ridge, whereby a secure lock may be formed between said lid and said ring when said lid is used to close the container.

10. The container assembly of claim 1, wherein the width of the downward extending flange of said lid is narrower than the width of the channel of said ring and wherein the downward extending flange further comprises vertical ribs spaced circumferentially around the inner periphery of said flange such that said vertical ribs extend the length of the downward extending flange and the combined width of the flange and said vertical ribs are about equal to the width of the channel of said ring.

11. The container assembly of claim 9, wherein the width of the downward extending flange of said lid is narrower than the width of the channel of said ring and wherein the downward extending flange further comprises vertical ribs spaced circumferentially around the outer periphery of said flange such that said vertical ribs extend the length of the downward extending flange and the combined width of the flange and said vertical ribs are about equal to the width of the channel of said ring.

12. A resealable plastic container assembly comprising:

a generally cylindrical plastic container having a bottom end, an upward extending sidewall, and an open top;

a plastic ring fitted within the inner circumference of the rim of the open top end of said container in interlocking relationship between said container, rim and said ring to provide a permanent and continuous leakproof seal between said container and said ring, said ring further comprising a channel along the inner periphery thereof opening upward with respect to the bottom of said container; and a lid for removable attachment with said ring comprising a substantially flat disk having a downwardly extending flange at the periphery of said disk adapted to fit within the channel of said ring and to provide a tight leakproof seal between said top and said ring, and further comprising a lip extension beyond said flange around the periphery of said lid at the top of said flange, for prying open said lid from said ring and container; and wherein the width of the downward extending flange of said lid is narrower than the width of the channel of said ring and wherein the downward extending flange further comprises vertical ribs spaced circumferentially around the outer periphery of said flange such that said vertical ribs extend the length of the downward extending flange and the combined width of the flange and said vertical ribs are about equal to the width of the channel of said ring.

13. A resealable plastic container assembly comprising:

a generally cylindrical plastic container having a bottom end, and upward extending sidewall, and an open top;

a plastic ring fitted within the inner circumference of the rim of the open top end of said container in interlocking relationship between said container, rim and said ring to provide a permanent and continuous leakproof seal between said container and said ring, said ring further comprising a channel along the inner periphery thereof opening upward with respect to the bottom of said container;

a lid for removable attachment with said ring comprising a substantially flat disk having a downwardly extending flange at the periphery of said disk adapted to fit within the channel of said ring and to provide a tight leakproof seal between said top and said ring, and further comprising a lip extension beyond said flange around the periphery of said lid at the top of said flange, for prying open said lid from said ring and container; and wherein the width of the downward extending flange of said lid is narrower than the width of the channel of said ring and wherein the downward extending flange further comprises vertical ribs spaced circumferentially around the inner periphery of said flange such that said vertical ribs extend the length of the downward extending flange and the combined width of the flange and said vertical ribs are about equal to the width of the channel of said ring.

* * * * *